US007946894B2

(12) United States Patent
AbuGhazaleh et al.

(10) Patent No.: US 7,946,894 B2
(45) Date of Patent: May 24, 2011

(54) ALIEN CROSSTALK PREVENTIVE COVER

(75) Inventors: Shadi A. AbuGhazaleh, Oakdale, CT (US); Douglas P. O'Connor, Richmond, RI (US)

(73) Assignee: Hubbell Incorporated, Shelton, CT (US)

( * ) Notice: Subject to any disclaimer, the term of this patent is extended or adjusted under 35 U.S.C. 154(b) by 92 days.

(21) Appl. No.: 12/285,428

(22) Filed: Oct. 3, 2008

(65) Prior Publication Data

US 2009/0098777 A1 Apr. 16, 2009

Related U.S. Application Data

(60) Provisional application No. 60/960,576, filed on Oct. 4, 2007.

(51) Int. Cl.
*H01R 24/00* (2006.01)

(52) U.S. Cl. ..... 439/676

(58) Field of Classification Search ..... 439/673, 439/676, 931, 404, 417, 395, 752, 578
See application file for complete search history.

(56) References Cited

U.S. PATENT DOCUMENTS

| | | | | |
|---|---|---|---|---|
| 4,988,550 | A | 1/1991 | Keyser et al. | |
| 5,062,804 | A * | 11/1991 | Jamet et al. | 439/394 |
| 5,295,857 | A * | 3/1994 | Toly | 439/395 |
| 5,573,857 | A | 11/1996 | Auger | |
| 6,582,250 | B2 | 6/2003 | Taylor et al. | |
| 6,743,052 | B1 | 6/2004 | Lin et al. | |
| 6,799,997 | B2 | 10/2004 | Lin et al. | |
| 7,249,974 | B2 * | 7/2007 | Gordon et al. | 439/607.41 |
| 7,273,396 | B2 | 9/2007 | Itano et al. | |
| 2005/0042922 | A1 | 2/2005 | Haller et al. | |
| 2006/0134995 | A1 | 6/2006 | Bolouri-Saransar et al. | |
| 2006/0185884 | A1 | 8/2006 | Ortiz et al. | |
| 2007/0082540 | A1 | 4/2007 | Mullin et al. | |

* cited by examiner

*Primary Examiner* — Jean F Duverne
(74) *Attorney, Agent, or Firm* — Jenae C. Gureff; Mark S. Bicks; Alfred N. Goodman

(57) ABSTRACT

A conductive cover or shield for reducing crosstalk between a plurality of connectors arranged adjacent one another. A cover having a non-conductive interior surface and a conductive outer surface. The non-conductive surface is adhered to the exterior surface of a connector or a plurality of IDC towers for preventing crosstalk between adjacent connectors. Also, the cover can be form fitted and secured to the connectors, specifically, adhering to the corners to insulate any loose wires.

14 Claims, 8 Drawing Sheets

FIG. 11
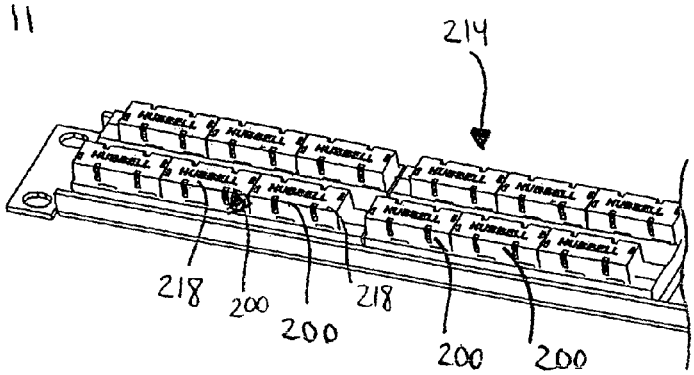
FIG. 12
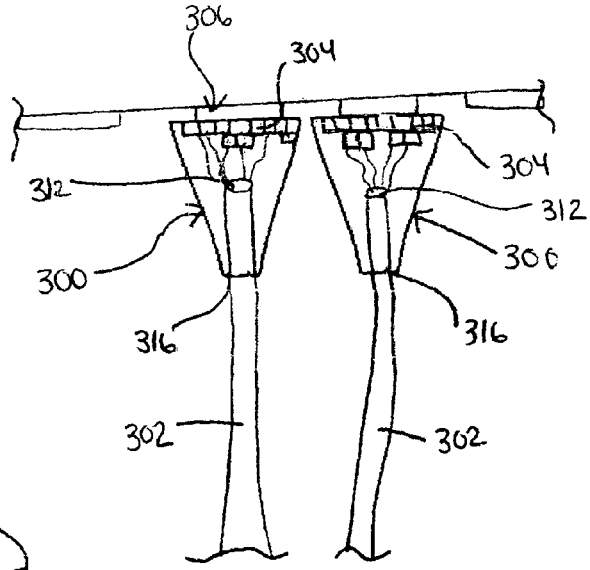
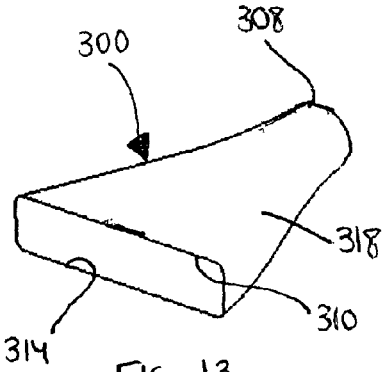
FIG. 13
FIG. 14
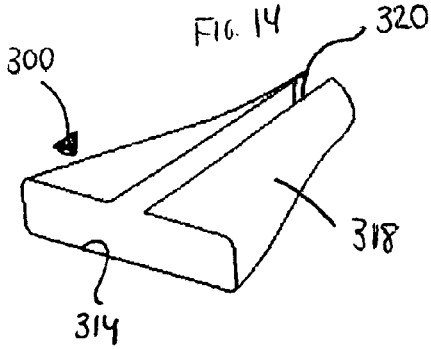

ALIEN CROSSTALK PREVENTIVE COVER

CROSS-REFERENCE TO RELATED APPLICATIONS

This application claims the benefit of U.S. Provisional Application 60/960,576 filed Oct. 4, 2007, which application is hereby incorporated by reference in its entirety.

FIELD OF THE INVENTION

The present invention relates to a conductive cover or shield for reducing crosstalk between connectors arranged in a side-by-side configuration. More particularly, the invention relates to a cover having a non-conductive interior surface disposed adjacent to a plurality of IDC towers and a conductive exterior surface for preventing crosstalk between adjacent connectors. Optionally, the conductive surface could be layered between multiple non-conductive surfaces.

BACKGROUND

Conventional cables and electrical connectors arranged in sets and in parallel are oftentimes too close together and result in inductive or capacitive interference therebetween. The proximity of the connectors is necessary because of the limited spacing within patch panels, however this proximity has its disadvantages in causing crosstalk between adjacent connectors.

A need exists for a device that can prevent or minimize alien crosstalk, i.e., crosstalk between electrical connectors. Specifically, there exists a need for a device that is useful in tight (high-density) configurations where the spacing between the connectors is less than the minimum needed to maintain the desired alien crosstalk levels.

SUMMARY OF THE INVENTION

Accordingly, an object of the present invention is to provide a conductive cover around each of a plurality of adjacent electrical connectors to reduce crosstalk therebetween.

Another object of the present invention is to provide a cover for preventing crosstalk while simultaneously retaining the electrical effectiveness of the connectors.

Yet another object of the present invention is to provide a shield around a plurality of IDC towers as an alternative to plating.

Still another object of the present invention is to provide a slotted shield for receiving a cable even if the cable has been terminated.

A further object of the present invention is to provide a ring shield used at installation with a continuous surface or retrofit with a hinge or simple bend for protecting the IDC towers.

Another object of the present invention is to provide a conductive cover for a jack having a substantially U-shaped opening with first and second tabs protruding into the opening from the conductive cover to secure the cover to the stuffer cap.

Still another object of the present invention is to provide a cover for a jack with a conductive intermediate or exterior surface, or layer, for reducing crosstalk between a plurality of jacks and a non-conductive interior surface for insulating the stuffer cap and plurality of IDC towers that are not covered by the stuffer cap.

Yet another object of the present invention is to provide a cover for a jack body that covers at least two sides of the connector in order to reduce the amount of material used, reducing the overall connector size, and eliminating the possibility of shield-to-shield coupling.

The foregoing objects are basically attained by providing a cover around the exterior of a plurality of IDC towers, preferably assembled in a jack, having a conductive outer surface and a non-conductive inner surface. The inner surface is adjacent to the IDC towers and the outer surface faces the supplemental connectors. The conductive cover can be foil or metal whereas the non-conductive cover is adhesive laminate. In another embodiment, the cover is a shield that can be applied around the IDC towers at installation or retrofit. Various options of the shield include a longitudinal slot, bend, or hinge.

By forming the cover in this manner, the conductive outer surface and non-conductive inner surface prevent alien crosstalk between a plurality of adjacent connectors while simultaneously insulating a plurality of IDC towers disposed beneath.

Other objects, advantages, and salient features of the present invention will become apparent from the following detailed description, which, taken in conjunction with the annexed drawings, discloses preferred embodiments of the invention.

BRIEF DESCRIPTION OF THE DRAWINGS

Referring to the drawings which form a part of this disclosure:

FIG. 11 is a top perspective view of a plurality of caps aligned side-by-side, each having a conductive cover similar to that shown in FIGS. 8-10;

FIG. 12 is a top plan view of a plurality of IDC towers covered by a protective shield according to a fourth embodiment of the present invention;

FIG. 13 is a side perspective view of the shield as shown in FIG. 12;

FIG. 14 is a side perspective view of a shield according to a fifth embodiment of the present invention, having a longitudinal opening between first and second ends of the shield for a retrofit application;

Throughout the drawings, like reference numerals will be understood to refer to like parts, components, and structures.

DETAILED DESCRIPTION OF THE INVENTION

Figure 2:
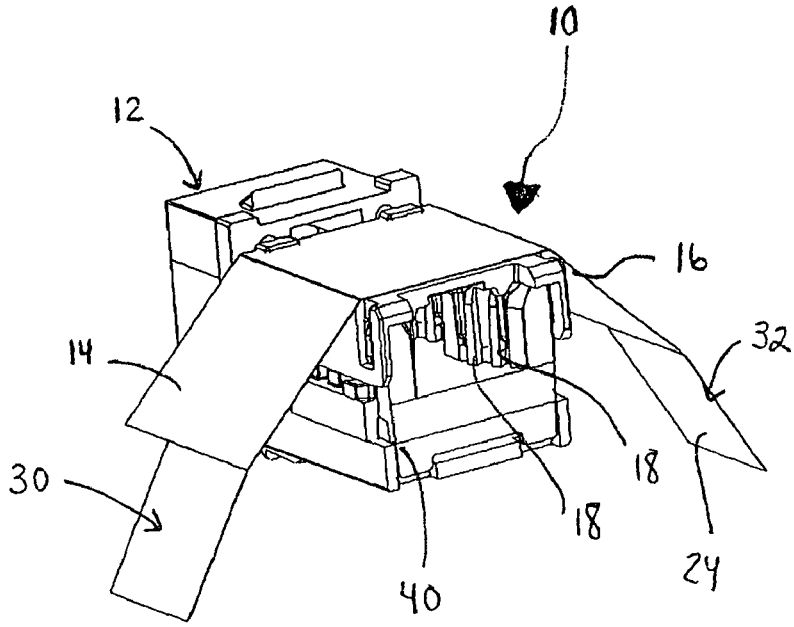
FIG. 2 is a front perspective view of the cover adhered to the top of the jack as shown in FIG. 1.

As seen in FIGS. 1-4, a cover 10 for reducing crosstalk between modular electrical connectors or jacks 12 includes an outer conductive surface 14 wrapped around a jack 12 with a first edge 16 adjacent to a plurality of IDC towers 18 and a second edge 20 adjacent a plug opening 22. The cover 10 also includes an inner non-conductive surface 24 opposite the outer surface 14. The non-conductive surface 24 is disposed on a top surface 26 of the jack 12, adjacent to a stuffer cap 28. More specifically, the non-conductive surface 24 is attached to an end of the connector 12 adjacent to a plurality of insulation displacement contacts (IDC) towers 18 supporting the IDCs.

The cover 10 is flexible such that it can be wrapped around the entire perimeter of the connector 12 closest to the cable end 40 (for receiving a cable 42). The outer surface 14 can be manufactured of foil, metal, or a similarly-suitable conductive material such as a molded conductive plastic, an extruded or formed metal part, or a painted or plated plastic part. The inner surface 24 on the reverse side of the cover 10, as the outer surface 14, is manufactured from a non-conductive material. Preferably, the material is a plastic laminate with an adhesive inner layer for adhering the cover 10 to the top surface 26 of the connector 12. Specifically, the top inner surface 24 adheres to the stuffer cap 28.

Optionally, the cover could be multi-layered such that the conductive layer is adjacent one or more non-conductive layers. In a preferred embodiment, a third outer layer is non-conductive. This layer may be a print layer, but more importantly, it would prevent the conductive surfaces or other layers (from adjacent connectors) from coupling, which might result in undesired harmonic coupling.

Figure 3:
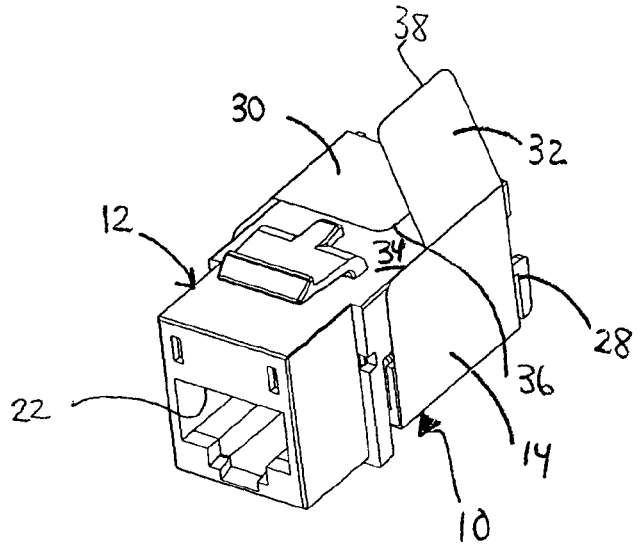
FIG. 3 is a bottom perspective view of the cover surrounding the perimeter of the jack with one of the tabs folded over the jack shown in FIGS. 1 and 2.

The cover 10 is adhered to and surrounds at least two, but preferably three or more, sides of the connector 12. As seen in FIG. 3, the cover 10 is further secured to the connector 12 by attaching a first tab 30 to the bottom surface 34 of the connector 12 and wrapping a first tab 30 around a second tab 32 for securing the cover 10 to the connector 12. The tabs 30, 32 are disposed along the outermost ends of the cover 10.

Figure 5:
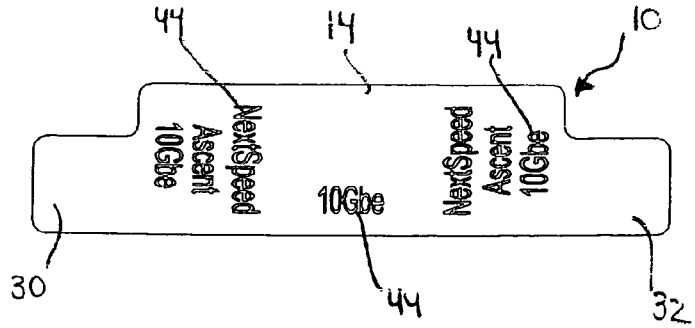
FIG. 5 is a top plan view of a conductive cover, similar to that shown in FIGS. 1-4 with the exception of contoured ends along the corners.

The stuffer cap 28 is immediately beneath the inner surface 24 of the cover 10. The purposes of the stuffer caps 28 are to force the wires into the IDCs to insulate the IDC towers 18 and wires therebetween. In this manner, the cover 10 surrounds the entire perimeter of the connector 12, and thus, the stuffer cap 28. Effectively, this wrapping insulates any wires that escape from beneath the stuffer cap 28 and bottom of the connector 12, if they were not properly trimmed within the IDC towers 18. The wires could be subjected to short circuits if the connector 12 is left uncovered. As seen in FIG. 5, the cover 10 can have rounded or contoured corners to smoothly fold over the edges of the connector 12. Also, the cover 10 is a printable label (or tape) with non-conductive adhesive and conductive outer material.

Figure 1:
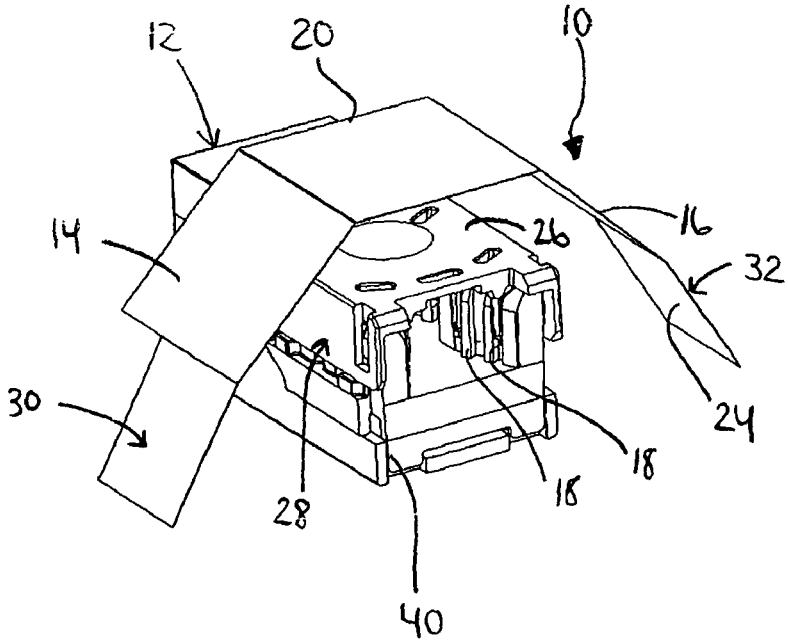
FIG. 1 is an exploded perspective view of a jack and a conductive cover according to a first embodiment of the present invention.
Figure 1A:
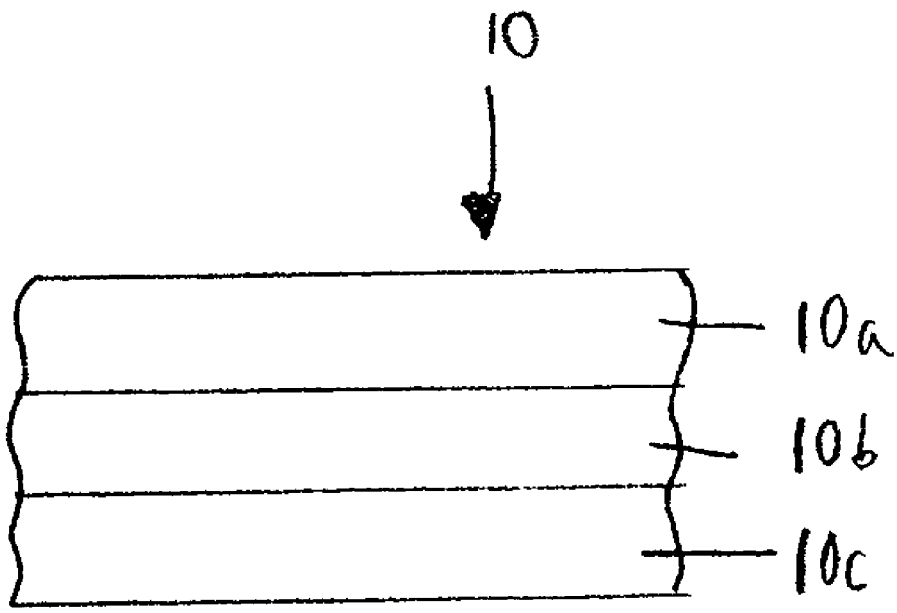
FIG. 1*a* is a cross-sectional view of a cover as seen in FIG. 1.

As seen in FIG. 1*a*, the cover 10 could include a non-conductive adhesive layer 10*c*, a conductive layer 10*b* adjacent to the non-conductive layer 10*c*, and a non-conductive layer 10*a* on the side of the conductive layer 10*b* opposite that of the non-conductive adhesive layer 10*c*. Thus, the conductive layer 10*b* is an intermediate layer. There can be multiple layers of the cover 10.

An unprintable conductive tape can be used, preferably with non-conductive adhesive to achieve the same result as the printable label. The printable labels are advantageous because identifying information 44 can be printed thereon, best seen in FIG. 5. The conductive nature of the label blocks alien crosstalk coupling between any two connectors. This label is particularly useful in reducing the coupling between IDC contacts and the associated wires of two connectors when in very close physical proximity due to connector placement. The non-conductive adhesive is the preferred embodiment because it reduces the possibility of creating an electrical short if the wires are not trimmed properly and accidentally come into contact with the label.

Figure 6:
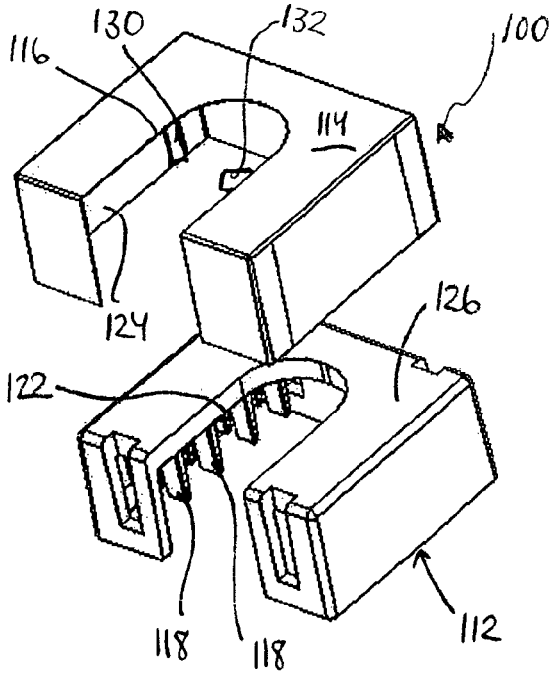
FIG. 6 is an exploded top view of a jack and a conductive cover according to a second embodiment of the present invention.
Figure 7:
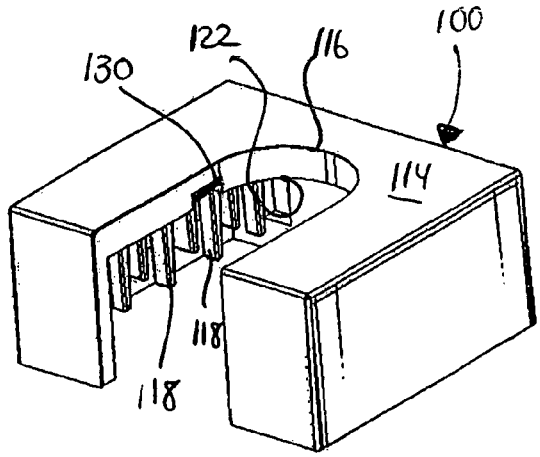
FIG. 7 is an assembled top perspective view of the jack and cover as shown in FIG. 6.
Figure 8:
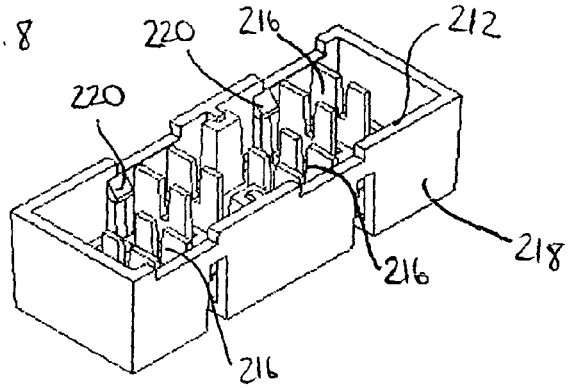
FIG. 8 is a bottom perspective view of a stuffer cap according to a third embodiment of the invention.
Figure 9:
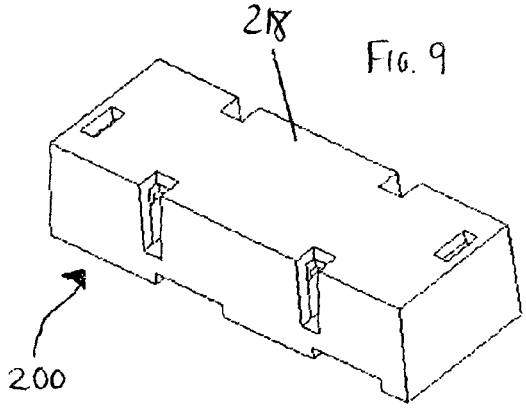
FIG. 9 is a top perspective view of the stuffer cap as shown in FIG. 8.
Figure 10:
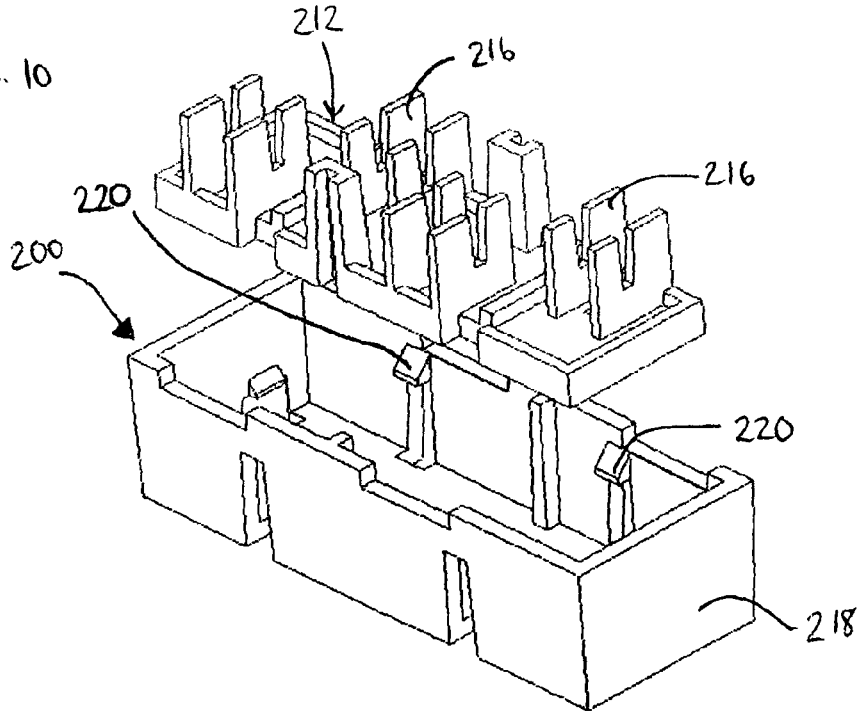
FIG. 10 is an exploded perspective view of the stuffer cap and plurality of IDC towers as shown in FIGS. 8 and 9.

A second embodiment, illustrated in FIGS. 6 and 7, includes a cover 100 for reducing crosstalk between connectors 112 having a different shape than those of FIGS. 1-5 but involves a similar concept. The connectors 112 of the present embodiment are defined by a substantially U-shaped opening 122. The cover 100 includes an outer conductive surface 114, such as foil or metal, wrapped around a connector 112 and an inner non-conductive surface 124 opposite the outer surface 114. The non-conductive surface 124, such as a plastic laminate with an adhesive inner layer, is disposed on a top surface 126 of the connector 112. More specifically, the non-conductive surface 124 is attached to an end of the connector 112 adjacent to the stuffer cap and IDC projections 118 that fit into the slots of IDC towers.

Figure 4:
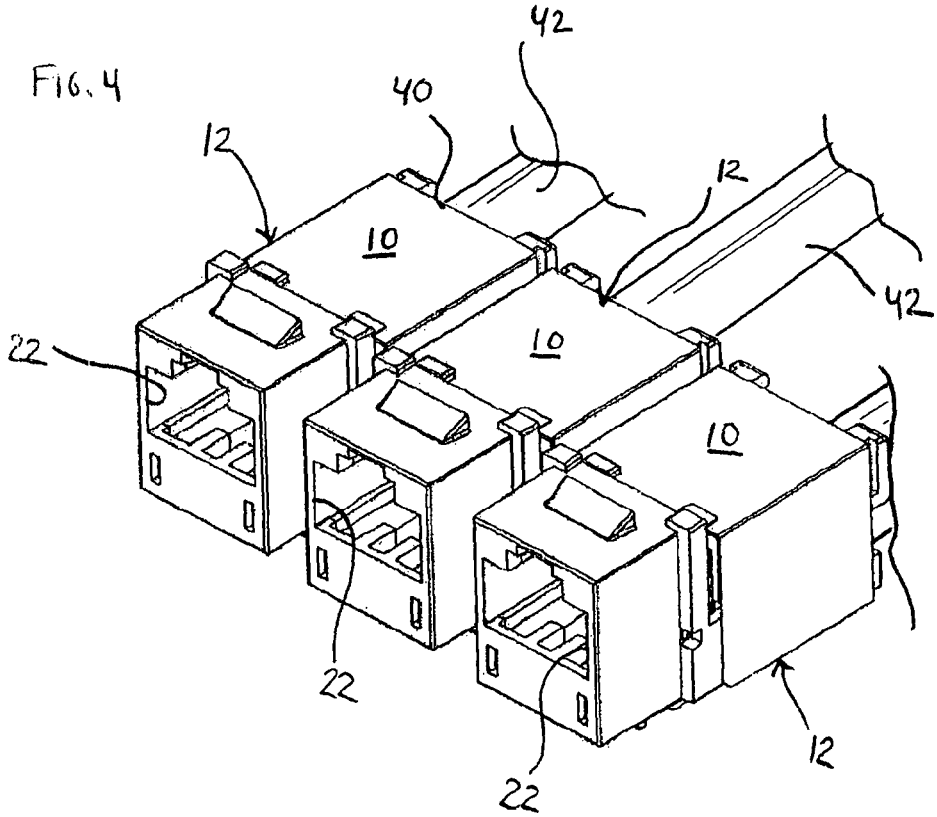
FIG. 4 is a front perspective view of a plurality of jacks aligned side-by-side, each having the conductive cover shown in FIGS. 1-3.

The cover 100 is flexible and wrapped almost entirely around the perimeter of the connector 112. At least one side of the cover 100 includes a substantially U-shaped surface 116 to adhere to the substantially U-shaped opening 122 of the connector 112. As seen in FIGS. 4 and 5, the side 126 of the connector 112 adjacent the U-shaped opening 122 is not entirely covered by the cover 100. The cover 100 is adhered to the remaining surfaces of the connector 112.

The cover 100 further includes first and second tabs 130, 132 along an outer edge of the connector 112. These tabs 130, 132 fold over substantially 90-degrees from the edge of the foil cover 100 to grasp the stuffer cap. First tab 130 and second tab132 fold inwardly substantially 90-degrees from the edge of the foil cover 100 to grasp the interior of the stuffer cap 128 towards the U-shaped opening 122. Similarly, external tabs fold over substantially 90-degrees from the edge of the foil cover 100, adjacent the outer edge of the connector 100, opposite the U-shaped opening 122 to grasp the interior of the stuffer cap 128 and further secure the cover 100 to the connector 112.

Turning to a third embodiment of the invention, illustrated in FIGS. 8-11, a cover or stuffer cap 200 is used to prevent alien crosstalk between connectors arranged in a side-by-side arrangement on a panel 214. Each of the covers 200 includes a conductive surface or layer 218 with a substantially rectangular-shape. The covers 200 include a plurality of IDC tower projections 216. Each cover 200 is molded of conductive plastic and acts as a shield against crosstalk from the other caps 212. Optionally, the covers 200 or caps could be painted with conductive paint to provide crosstalk preventive results. The IDC tower projections 216 could also be painted with metallic, conductive paint or plated with a conductive layer. The contoured design of the cover 200 is molded with side barriers 220 to snap onto the connectors.

The fourth embodiment, involves the use of a cable shield, as seen in FIGS. 12-14. A shield 300 is an alternative to plating an adapter. The shield 300 surrounds the tip 312 of a cable 302 and a plurality of IDC towers 304 located on a panel 306. The shield 300 includes a first end 308 and a second end 310 having a second opening 314 larger than the first opening 316 of the first end 308. The first end 308 is the narrowest point of the shield 300 to fit around the cable 302. The main body 318 of the shield 300 gradually expands towards the second opening 314 that surrounds the IDC towers 304. The shield 300 can protect the IDC towers 304 at installation or subsequently as an addition to the panel 306. The cable 302 passes laterally through an opening, feeds into the shield 300, enabling the shield 300 to move up and envelop the IDC towers 304.

The shield 300 can be equipped with a longitudinal slot 320 extending from the first opening 316 along the main body 318 to the second opening 314. The slot 320 allows for the cable 302 to be inserted into the shield 300 even if the cable 302 has been terminated. In other words, the longitudinal slot 320 enables the retrofit function of the shield 300.

Figure 15:
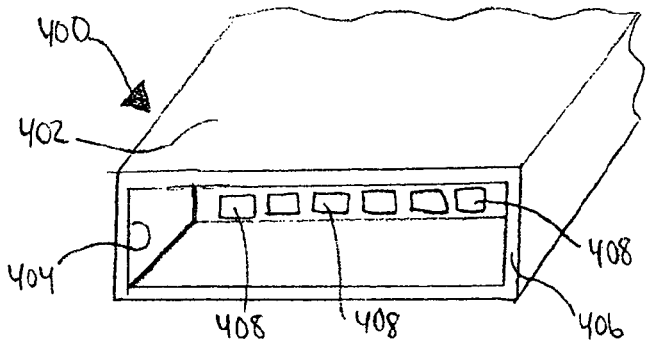
FIG. 15 is a side perspective view of a sixth embodiment of the present invention showing a shield with a continuous surface.
Figure 16:
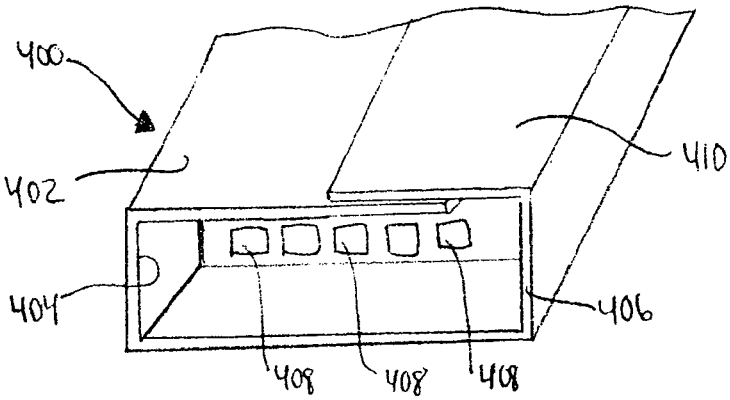
FIG. 16 is a side perspective view of a seventh embodiment of the present invention showing a shield with a hinge or bend along its surface.
Figure 17:
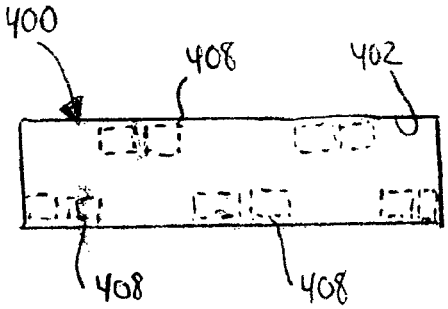
FIG. 17 is a top plan view of a shield according to an eighth embodiment of the present invention showing a plurality of IDC towers within the shield.

Another type of shield, seen in FIG. 15, is a rectangular parallelepiped ring shield 400. The ring shield 400 can also be used at installation or retrofit (see FIGS. 16 and 17). The ring shield 400 is defined by a continuous surface 402 flanked by a first end 404 and a second end 406 opposite the first end 404. The shield 400 wraps around a plurality of IDC towers 408. It is best used to protect the IDC towers 408 and reduce the component hardware. It snaps onto the towers 408. If the shield 400 is used to retrofit to the IDC towers 408, the shield 400 includes a hinge or bend 410 to conform to the correct size of the IDC tower 408 width.

Figure 18:
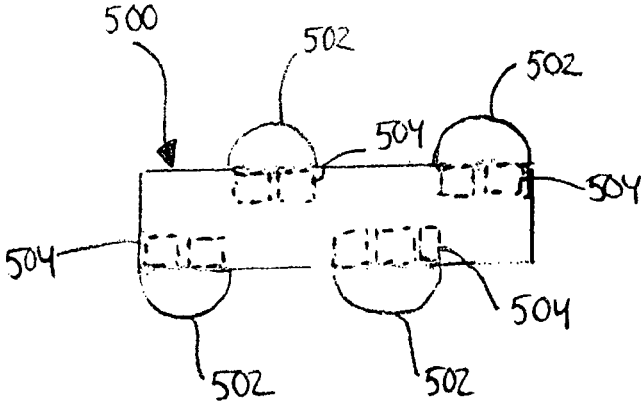
FIG. 18 is a top plan view of a shield according to a ninth embodiment of the present invention showing a plurality of IDC towers within the shield.

To prevent the shields from shorting to the end of an electrical wire, modifications can be made to the insulation or shape of the shield. Insulating material can be added to the interior surface of the shield. In another example, turning to FIG. 18, a shield 500 can be shaped to reduce the possibility of the wire ends contacting any surfaces outside of the shield. Thus, in this embodiment, the shield 500 includes a plurality of scalloped surfaces 502 that overhang the ends of the IDC towers 504. The scalloped surfaces 502 compensate for the shape of the IDC towers 504.

Figure 19:
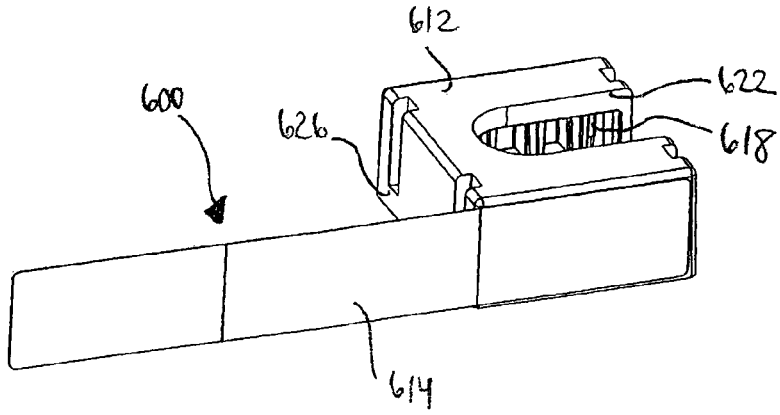
FIG. 19 is a pre-assembled side perspective view of a jack and a conductive cover according to a tenth embodiment of the present invention.
Figure 20:
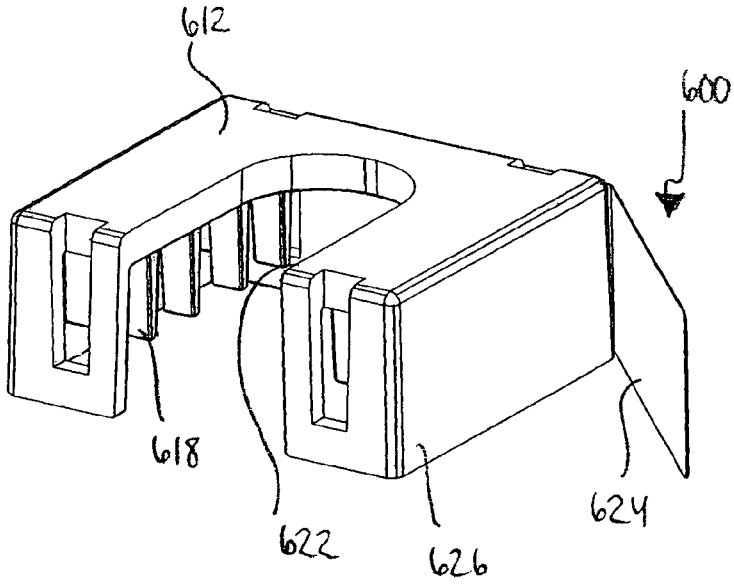
FIG. 20 is a semi-assembled side perspective view of the jack and cover as shown in FIG. 19.
Figure 21:
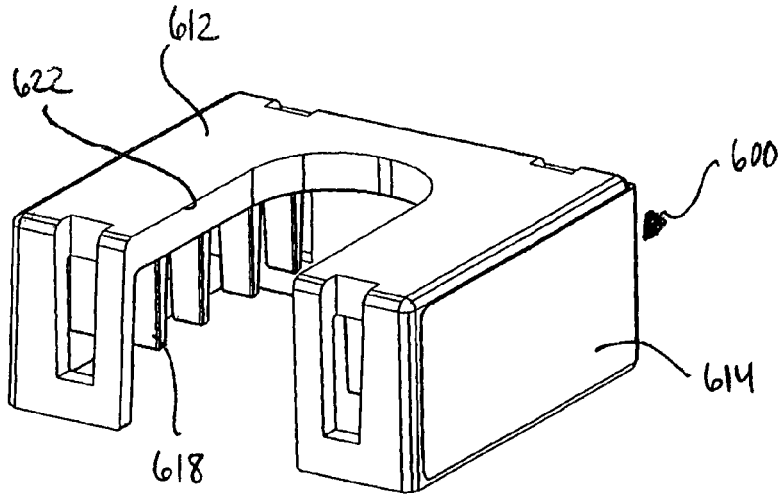
FIG. 21 is an assembled side perspective view of the jack and cover as shown in FIGS. 19 and 20.

In a tenth embodiment, illustrated in FIGS. 19-21, a cover 600 can surround the exterior surface 626 of the connector 612 without surrounding the entire body of the connector 612. This is effective when multiple connectors 600 are assembled on top of each other. The cover 600 has a conductive outer surface 614 that faces away from the connector surface 626. The cover 600 is attached to the three uniform sides of the connector 600, as seen in the sequence of FIGS. 19-21.

In the above embodiments, it will be understood by those skilled in the art that the cover can also be applied towards the end of the jack adjacent the plug opening. The cover may also surround the entire body of the jack between the plug end and cable end. Thus, using a conductive cover in any, or all, of these regions results in a similar reduction of alien crosstalk.

While a particular embodiment has been chosen to illustrate the invention, it will be understood by those skilled in the art that various changes and modifications can be made therein.

What is claimed is:

1. A covered jack comprising:

a jack body with a plurality of IDC towers at one end thereof and a plug opening at an opposite end thereof;

a stuffer cap mounted on said IDC towers;

an outer conductive surface wrapped around said jack body, having a first edge adjacent to said plurality of IDC towers, a second edge adjacent to said plug opening, and first and second tabs disposed along the outermost ends thereof; and an inner non-conductive surface opposite said outer conductive surface and disposed on a top surface of said jack body, adjacent to said stuffer cap and attached to said end of said jack adjacent to said plurality of IDC towers such that one of said tabs wraps around the other of said tabs for securing said outer conductive surface to said connector.

2. A covered jack according to claim 1 wherein said outer conductive surface comprises foil.

3. A covered jack according to claim 1 wherein said outer conductive surface is metallic.

4. A covered jack according to claim 1 wherein said outer conductive surface comprises a molded conductive plastic.

5. A covered jack according to claim 1 wherein said outer conductive surface comprises an extruded or formed metal part.

6. A covered jack according to claim 1 wherein said outer conductive surface comprises a painted or plated plastic part.

7. A covered jack according to claim 1 wherein said inner non-conductive surface comprises a plastic laminate with an adhesive layer on an inner surface therein.

8. A covered connector assembly for reducing crosstalk between connectors, comprising:

a jack body having a substantially U-shaped opening with a plurality of IDC towers at one end thereof and a plug opening at an opposite end thereof;

a stuffer cap mounted on said IDC towers;

an outer conductive surface wrapped around said jack body, said surface comprising foil or metallic, and a substantially U-shaped surface with an adhesive layer on an inner surface thereof;

an inner non-conductive surface opposite said outer surface adhered to the exterior of said jack body, adjacent to said stuffer cap; and, first and second tabs along an outer edge of said jack body, disposed adjacent to said substantially U-shaped surface such that said tabs fold inwardly towards said substantially U-shaped opening.

9. A covered connector assembly according to claim 8 wherein said cover surrounds the entire perimeter of said jack body.

10. A cover arrangement for reducing crosstalk between connectors, comprising:

a panel having a plurality of IDC towers;

a plurality of stuffer caps surrounding said plurality of IDC towers, wherein each of said stuffer caps is aligned adjacent another of said stuffer caps, each of said caps includes a conductive exterior surface with a substantially rectangular-shape; and a plurality of side barriers disposed along said cover to snap around said plurality of IDC towers.

11. A cover arrangement according to claim 10 wherein each of said caps comprises conductive plastic.

12. A cover arrangement according to claim 10 wherein each of said caps comprises conductive paint or conductive plating.

13. A covered cable reducing crosstalk between connectors, comprising:

a shield member surrounding a plurality of IDC towers, said shield having a first end and a second wider end with a contoured surface therebetween;

a cable coupled to said plurality of IDC towers received within said shield member; and a longitudinal slot extending between said first end and said second end allowing said cable to pass laterally through an opening when connected to said plurality of IDC towers.

14. A covered cable reducing crosstalk between connectors, comprising:

a plurality of IDC towers disposed on a panel;

a shield sleeve surrounding said plurality of IDC towers, said shield having a first end and a second end of equal width with a continuous surface therebetween;

a hinge along said continuous surface;

a longitudinal slot extending between said first end and said second end such that said shield is adapted to retrofit to said connectors; and a cable adjacent to said plurality of IDC towers received within said shield.

* * * * *